US011365579B2

(12) United States Patent
Ichinose

(10) Patent No.: US 11,365,579 B2
(45) Date of Patent: Jun. 21, 2022

(54) AUTOMATIC DOOR OPENING AND CLOSING SYSTEM

(71) Applicant: MITSUI KINZOKU ACT CORPORATION, Yokohama (JP)

(72) Inventor: Mikio Ichinose, Yokohama (JP)

(73) Assignee: MITSUI KTNZOKU ACT CORPORATION, Yokohama (JP)

( * ) Notice: Subject to any disclaimer, the term of this patent is extended or adjusted under 35 U.S.C. 154(b) by 319 days.

(21) Appl. No.: 16/664,499

(22) Filed: Oct. 25, 2019

(65) Prior Publication Data

US 2020/0141176 A1 May 7, 2020

(30) Foreign Application Priority Data

Nov. 1, 2018 (JP) ..... JP2018-206772

(51) Int. Cl.
*E05F 15/00* (2015.01)
*E05F 15/73* (2015.01)
*E05B 81/64* (2014.01)

(52) U.S. Cl.
CPC ..... *E05F 15/73* (2015.01); *E05B 81/64* (2013.01); *E05Y 2900/531* (2013.01)

(58) Field of Classification Search
CPC . E05F 15/40; E05F 15/73; E05F 15/77; E05F 2015/7678; E05F 2015/763; E05F 2015/483; G06K 9/00805; G06T 7/70; G06T 2207/03261; E05Y 2400/44; E05Y 2400/54; E05Y 2400/85; E05Y 2900/531; E05Y 2201/422; E05Y 2800/00; E05Y 2400/53; E05Y 2400/532; B60J 5/047; E05B 81/64; E05C 17/006
USPC ..... 49/31
See application file for complete search history.

(56) References Cited

U.S. PATENT DOCUMENTS

| | | | | |
|---|---|---|---|---|
| 7,761,209 | B2 | 7/2010 | Morris et al. | |
| 10,479,319 | B1 * | 11/2019 | Wengreen | E05B 81/56 |
| 10,927,584 | B2 * | 2/2021 | Pohl | E05F 15/46 |
| 11,085,221 | B2 * | 8/2021 | Lin | B60J 5/047 |
| 2016/0078763 | A1 * | 3/2016 | Kiyokawa | G06K 9/00812 382/104 |
| 2018/0101187 | A1 * | 4/2018 | Iantorno | G11C 29/028 |

(Continued)

FOREIGN PATENT DOCUMENTS

| | | | | |
|---|---|---|---|---|
| CN | 104746999 | * 7/2015 | | E05F 15/73 |
| DE | 102015005544 | * 12/2015 | | E05Y 2900/531 |

(Continued)

*Primary Examiner* — Chi Q Nguyen
(74) *Attorney, Agent, or Firm* — Foley & Lardner LLP

(57) ABSTRACT

An automatic door opening and closing system includes a distance measuring device measuring a distance between an external surface of a swing door of a vehicle and an object lying on a circumference of the swing door, a door lock device locking the swing door, a drive device opening and closing the swing door, a door opening operation input device receiving an operation to cancel the locking of the swing door and to open the swing door, and a control device controlling the door lock device and the drive device based on the distance measured in response to receiving the operation. The distance measuring device includes a plurality of distance sensors placed dispersively over the swing door, a measurement target by the distant measuring device including a whole of the external surface of the swing door.

8 Claims, 12 Drawing Sheets

(56) References Cited

U.S. PATENT DOCUMENTS

| | | | | |
|---|---|---|---|---|
| 2018/0238099 | A1 | 8/2018 | Schatz et al. | |
| 2019/0145150 | A1* | 5/2019 | Kidena | G06N 20/00 701/49 |
| 2020/0098128 | A1* | 3/2020 | Fujii | G06T 7/60 |
| 2020/0149329 | A1* | 5/2020 | Miyashiro | E05B 81/64 |
| 2020/0232262 | A1* | 7/2020 | Marlia | B60R 25/34 |
| 2020/0386037 | A1* | 12/2020 | Battlogg | E05F 15/40 |
| 2021/0023994 | A1* | 1/2021 | Watanabe | B60R 1/00 |
| 2021/0303878 | A1* | 9/2021 | Hori | E05F 15/40 |

FOREIGN PATENT DOCUMENTS

| | | | |
|---|---|---|---|
| JP | 2014-194123 | A | 10/2014 |
| JP | 2015-031108 | A | 2/2015 |

* cited by examiner

AUTOMATIC DOOR OPENING AND CLOSING SYSTEM

CROSS-REFERENCE TO RELATED APPLICATIONS

This application is based on and claims priority under 35 USC 119 from Japanese Patent Application No. 2018-206772 filed on Nov. 1, 2018, the contents of which are incorporated herein by reference.

TECHNICAL FIELD

The present disclosure relates to an automatic door opening and closing system for automatically opening and closing a door of a vehicle.

BACKGROUND

There is known a system for automatically opening and closing a door of a vehicle by driving the door by a motor. However, in the case where an obstacle exists on an opening path of the door, there is caused a risk of the door coming into contact with the obstacle. Then, there is also known a system for stopping the door from opening by detecting an obstacle existing on the opening path of the door (for example, refer to JP-A-2015-31108 (PTL 1), JP-A-2014-194123 (PTL 2), U.S. Pat. No. 7,761,209 (PTL 3)).

In a system described in PTL 1, the value of electric current flowing to a drive unit for driving a door is monitored to detect an obstacle based on a variation in the value of electric current. In a system described in PTL 2, an obstacle is detected based on a variation in electrostatic capacity formed around a door. In a system described in PTL 3, a distance between a door and an object is measured by an ultrasonic sensor or the like that is placed in a pillar of a main body of a vehicle to thereby detect an obstacle.

SUMMARY

Illustrative aspects of the disclosure provide an automatic door opening and closing system that can detect an obstacle existing on the circumference of a door before the door comes into contact with the obstacle accurately and in an ensured fashion to thereby avoid in advance a contact of the door with the obstacle.

According to one illustrative aspect of the disclosure, there may be provided an automatic door opening and closing system, comprising: a distance measuring device configured to measure a distance between an external surface of a swing door of a vehicle and an object lying on a circumference of the swing door; a door lock device configured to lock the swing door in a closed state; a drive device configured to open and close the swing door; a door opening operation input device configured to receive an operation to cancel the locking of the swing door by the door lock device and to open the swing door by the drive device; and a control device configured to, in response to receiving the operation by the door opening operation input device, control the door lock device and the drive device based on the distance measured by the distance measuring device, wherein the distance measuring device comprises a plurality of distance sensors placed dispersively over the swing door, a measurement target by the distant measuring device including a whole of the external surface of the swing door.

According thereto, the automatic door opening and closing system can be provided which can detect the obstacle existing on the circumference of the door before the door comes into contact with the obstacle accurately and in an ensured fashion to thereby avoid in advance the contact of the door with the obstacle.

BRIEF DESCRIPTION OF DRAWINGS

Illustrative embodiments of the present disclosure will be described in detail based on the following figures, wherein:

FIGS. 4A to 4C shows schematic diagrams depicting operations of the drive device shown in FIG. 3, in which FIG. 4A is a schematic diagram showing a swing door staying in a closed state, FIG. 4B is a schematic diagram showing the swing door staying in an ajar state, and FIG. 4C is a schematic diagram showing the swing door staying an open state;

DETAILED DESCRIPTION

In the related-art system of PTL 1, an increase in electric current value in the drive device that results from a contact of the door with an obstacle is detected. That is, in the system described in PTL 1, an obstacle is detected based on the premise of a physical contact of the door with the obstacle, and the system is not designed to avoid a contact of the door with the obstacle in advance.

In the related-art system described in PTL 2, an obstacle is detected based on a variation in electrostatic capacity that is correlated with a distance between the door and the obstacle, and hence, the obstacle can be detected before the door comes into contact with the obstacle. However, electrostatic capacity is easily affected by the environment around the door, whereby the accuracy with which an obstacle is detected is reduce, resulting in fears that a contact of the door with an obstacle cannot be avoided.

In the related-art system described in PTL 3, an obstacle is detected based on a distance between the door and an obstacle on the circumference of the door that is measured by the sensor placed in the pillar of the main body of the vehicle. Here, the door is normally curved so as to protrude outwards, and there may be a risk of a blind spot being generated for the sensor placed in the pillar due to the door being so curved, resulting in fears that an obstacle fails to be detected.

Therefore, illustrative aspects of the disclosure provide an automatic door opening and closing system that can detect an obstacle existing on the circumference of a door before the door comes into contact with the obstacle accurately and in an ensured fashion to thereby avoid in advance a contact of the door with the obstacle.

Figure 1:
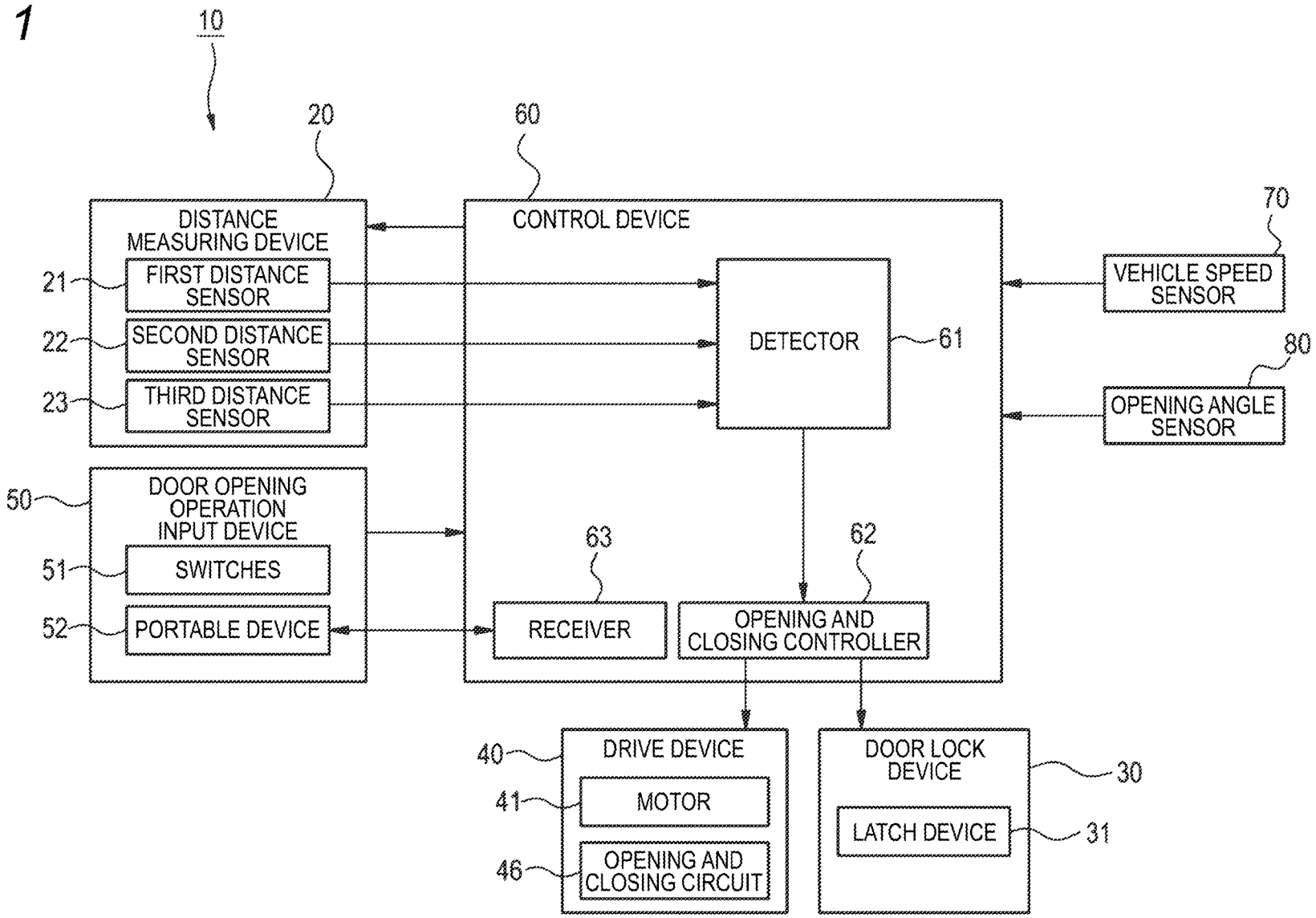
FIG. 1 is a functional block diagram of an example of an automatic door opening and closing system, depicting an illustrative embodiment of the disclosure.
Figure 2:
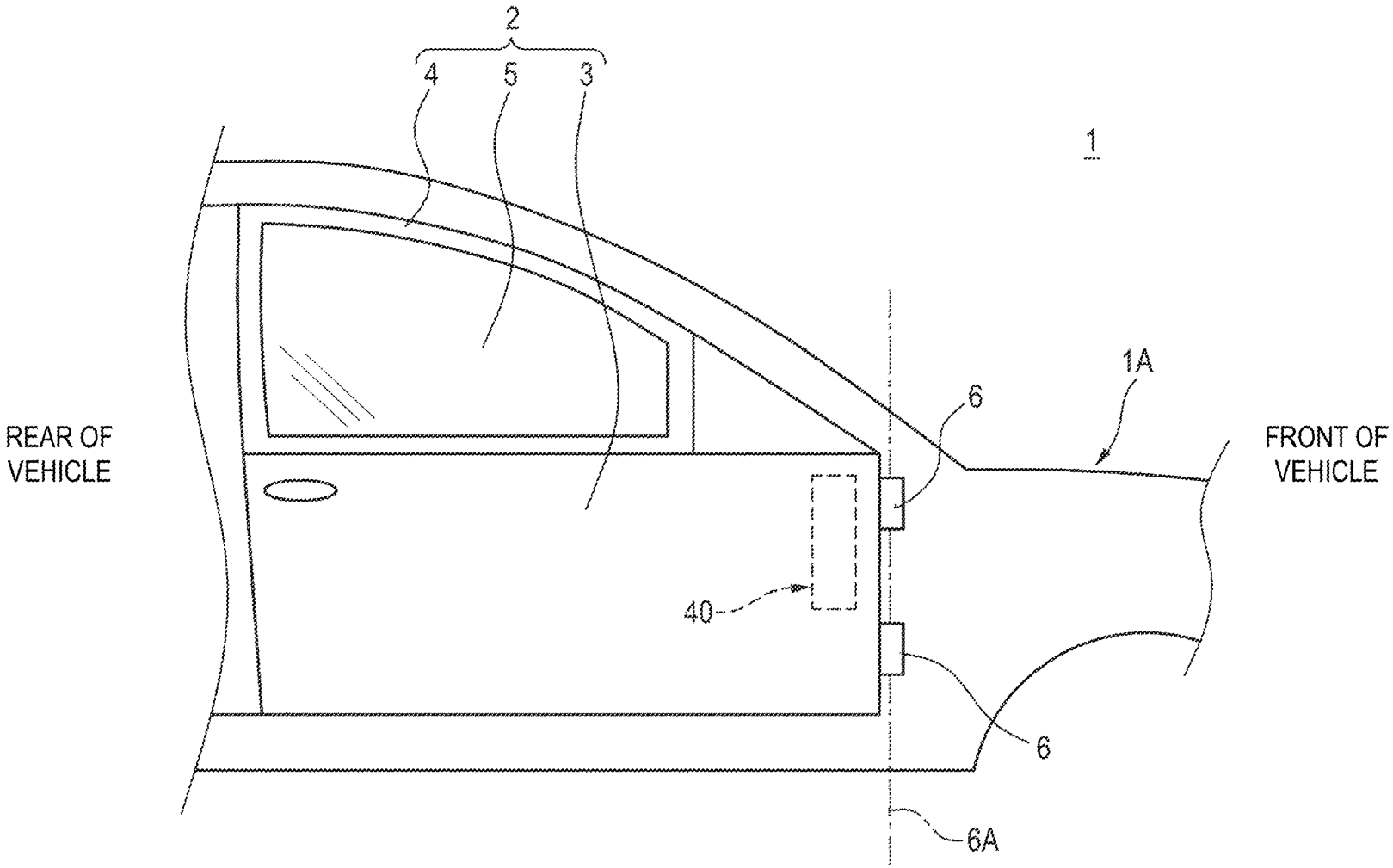
FIG. 2 is a schematic diagram of an example of a vehicle to which the automatic door opening and closing system shown in FIG. 1 is applied.

FIG. 1 shows an example of an automatic door opening and closing system, depicting an illustrative embodiment of the disclosure, and FIG. 2 shows an example of a vehicle to which the automatic door opening and closing system shown in FIG. 1 is applied.

An automatic door opening and closing system 10 is mounted in a so-called sedan-type vehicle 1 and automatically opens and closes a swing door 2 of the vehicle 1. The swing door 2 is supported on a vehicle main body 1A via hinges 6 in such a manner as to be opened and closed. Although the swing door 2, which constitutes a target to automatically be opened and closed by the automatic door opening and closing system 10, includes not only a front side door for a driver's seat and a front side door for a front passenger's seat but also rear side doors, in this illustrative embodiment, the configuration of the automatic door opening and closing system 10 will be described based on the front side door for the driver's seat.

The automatic door opening and closing system 10 includes a distance measuring device 20 configured to measure a distance to an object (hereinafter, also referred to as an "obstacle") on a circumference of the swing door 2, a door lock device 30 configured to lock the swing door 2 in a closed state, a drive device 40 configured to drive the swing door 2 to be opened and closed, a control device 60, and a door opening operation input device 50 configured to issue a command to the control device 60. When referred to in this illustrative embodiment, the obstacle can include a vehicle user who attempts to get in the vehicle 1, another vehicle parked adjacent to the vehicle 1, a curbstone of a road, and the like, but is not limited thereto. Various things can be considered as obstacles, as long as they interrupt the opening or closing of the swing door 2.

The distance measuring device 20 includes three distance sensors 21 to 23 and measures a distance between an outer surface of the swing door 2 and an object lying on the circumference of the swing door 2. A distance to be measured is a distance tangent to a swing path of the swing door 2. The distance sensors 21 to 23 are sensors configured to measure a distance using, for example, ultrasonic wave, LiDAR (Light Detection and Ranging, Laser Imaging Detection and Ranging), extreme high frequency radar, or the like. In this illustrative embodiment, although three distance sensors 21 to 23 are used on the swing door 2 for the driver's seat, the number of distance sensors is set as required according to a swing door constituting a target to be opened and closed, and hence, there is imposed no specific limitation on the number of sensors, as long as a distance between the outer surface of the swing door and an object can be measured.

The door lock device 30 includes a striker (not shown) attached to a door frame of the vehicle main body 1A and a latch device 31 attached to an inner panel (not shown) of the swing door 2. The swing door 2 is held in a closed state by the latch device 31 being locked on the striker. An actuator (not shown) including a motor is provided in the latch device 31, and the latch device 31 cancels the locking of the striker by the actuator being driven by the control device 60. This releases the locking of the swing door 2, whereby the swing door 2 can be opened.

The drive device 40 includes a motor 41 and an opening and closing circuit 46. The motor 41 configures a drive source of the drive device 40 and drives the swing door 2 in an opening direction and a closing direction via a link mechanism 43, which will be described later. The opening and closing circuit 46 supplies electric power to the motor 41 and cuts off the supply, and the opening and closing circuit 46 causes a short circuit across terminals of the motor 41 when cutting off the supply of electric power to the motor 41. The motor 41 stops operating quickly by the short circuit being caused across the terminals of the motor 41.

The door opening operation input device 50 includes switches 51 that are disposed on an instrument panel (not shown) in an interior of the vehicle main body 1A and a portable device 52 that is carried by the user, functioning as an external switch configured to be operated outside the vehicle main body 1A. The door opening operation input device 50 follows an operation of the switch by the user and instructs the control device 60 to control the door lock device 30 to unlock the swing door 2 and the drive device 40 to open the swing door 2.

The control device 60 is made up mainly of one or a plurality of processors and includes storage media such as ROM (Read Only Memory) and RAM (Random Access Memory) that store control programs to be executed by the processors and the results of processing by the processors. The storage media store and hold a first predetermined distance T1 and a second predetermined distance T2 that are used in controlling the door lock device 30 and the drive device 40. Further, a set angle is also stored and held in the storage media, and this set angle specifies an opening limit in opening the swing door 2 by the drive device 40.

Then, the control device 60, which operates according to the control programs, functions as a detector 61 to detect an obstacle on the circumference of the swing door 2 and also functions as an opening and closing controller 62 to open and close the swing door 2 by controlling the door lock device 30 and the drive device 40. Additionally, the control device 60 includes a receiver 63 as hardware. The receiver 63 can receive a command from the portable device 52 of the door opening operation input device 50 in a wireless fashion and can identify whether the portable device 52 stays in an exterior or an interior of the vehicle main body 1A. A communicable zone between the portable device 52 and the receiver 63 is zones residing, for example, within a radius of 1500 mm around the vehicle body 1A.

The opening and closing controller 62 controls the door lock device 30 and the drive device 40 in response to a command issued by the door opening operation input device 50 to open and close the swing door 2. Then, in opening the swing door 2 by the opening and closing controller 62, when the detector 61 detects an obstacle on the circumference of the swing door 2, the opening and closing controller 62 stops the swing door 2 before the swing door 2 comes into contact with the obstacle. The detector 61 detects the obstacle on the circumference of the swing door 2 based on a distance, measured by the distance measuring device 20, between the external surface of the swing door 2 and the object on the circumference of the swing door 2.

The control device 60 is electrically connected with a vehicle speed sensor 70 configured to detect a vehicle speed of the vehicle 1 and is also electrically connected with an opening angle sensor 80 configured to detect an opening angle of the swing door 2. A vehicle speed signal is inputted into the control device 60 from the vehicle speed sensor 70, and an opening angle signal is inputted into the control device 60 from the opening angle sensor 80.

The swing door 2 shown in FIG. 2 is a so-called sash door and includes a door main body 3 that can install therein a window glass 5 and a sash 4 that is provided in the form of a frame on the door main body 3. The sash 4 holds the window glass 5 and also guides the window glass 5 that is raised and lowered. The swing door 2 may be a sash-less door. The swing door 2 is connected to the vehicle main body 1A by the pair of hinges 6 provided at a front end portion of the door main body 3. The swing door 2 swings about a hinge axis 6A of the pair of hinges 6 to close, in an openable fashion, an opening in the vehicle main body 1A through which the driver get in and out of the vehicle main body 1A. The drive device 40 of the automatic door opening and closing system 10 is disposed in an interior of the door main body 3.

Figure 3:
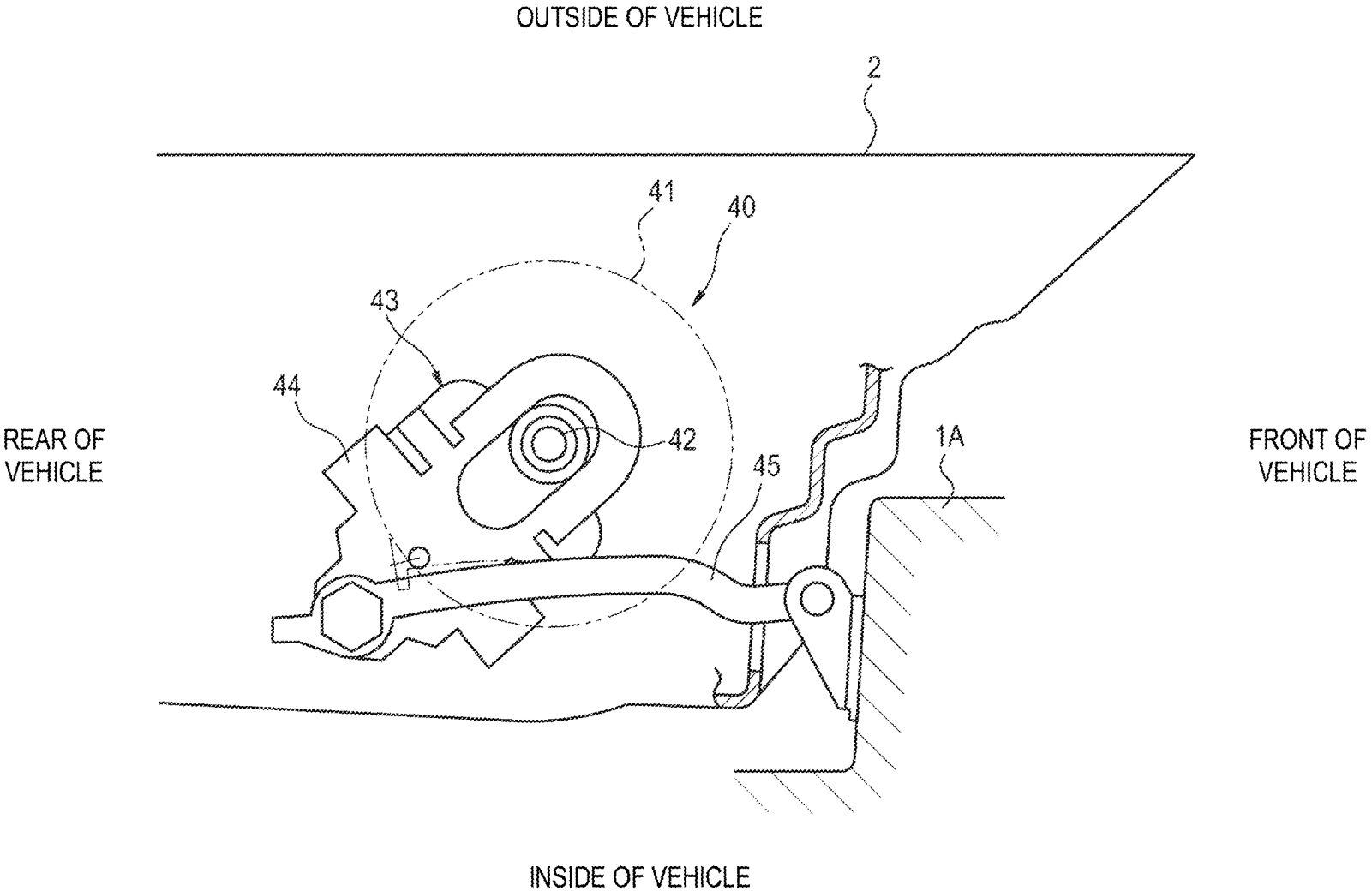
FIG. 3 is a schematic diagram of an example of a drive device shown in FIG. 1.
Figure 4A:
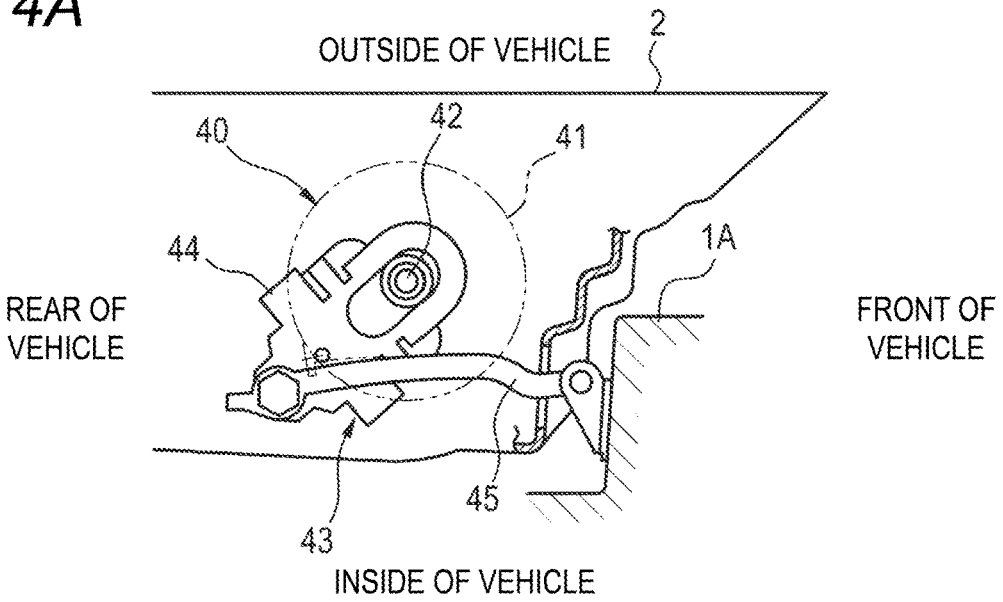
Figure 4B:
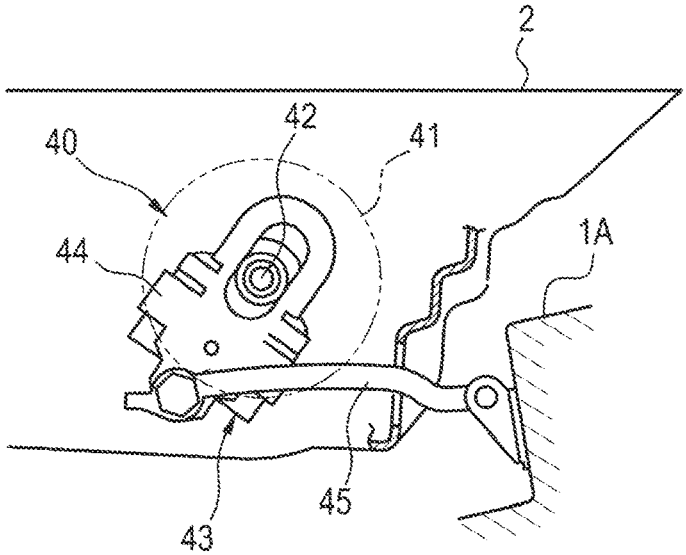
Figure 4C:
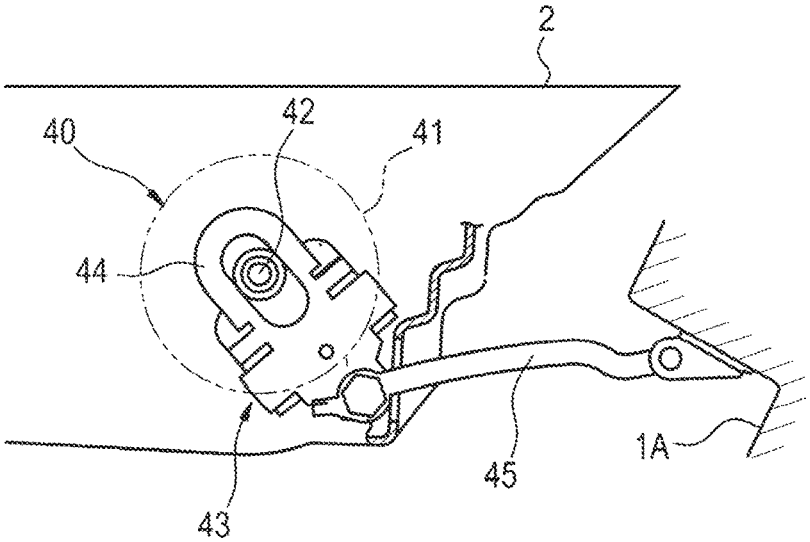

FIG. 3 shows an example of the drive device 40. FIGS. 4A to 4C depict operations of the drive device 40, in which FIG. 4A depicts the swing door 2 staying in a closed state, FIG. 4B depicts the swing door 2 staying an ajar state, and FIG. 4C depicts the swing door 2 staying in an open state.

The drive device 40 is disposed at a front end portion of the door main body 3. The drive device 40 includes the motor 41 and an output shaft 42. The motor 41 is attached to an inner panel of the door main body 3 via an appropriate bracket. The output shaft 42 is connected to the vehicle main body 1A via the link mechanism 43.

The link mechanism 43 includes a drive arm 44 and a driven arm 45. The drive arm 44 is fixed to the output shaft 42. A proximal end portion of the driven arm 45 is connected to the drive arm 44 rotatably, and a distal end portion of the driven arm 45 is connected to the vehicle main body 1A. As a result of this configuration, the drive device 40 opens and closes the swing door 2 as the motor 41 rotates.

Assuming that the lock of the swing door 2 by the door lock device 30 is released, for example, in the case where the swing door 2 stays in the closed state shown in FIG. 4A, when the motor 41 is rotated forwards, the rotation of the motor 41 is transmitted to the driven arm 45 via the output shaft 42 and the drive arm 44, whereby the driven arm 45 is pushed out of the door main body 3. As the driven arm 45 is pushed out, the swing door 2 is opened as shown in FIGS. 4B and 4C.

On the other hand, in the case where the swing door 2 stays in the open state as shown in FIG. 4C, when the motor 41 is rotated reversely, the rotation of the motor 41 is transmitted to the driven arm 45 via the output shaft 42 and the drive arm 44, whereby the driven arm 45 is pulled into the door main body 3. As the driven arm 45 is pulled into the door main body 3, the swing door 2 is closed as shown in FIGS. 4B and 4A.

A clutch mechanism (not shown) may be interposed between the motor 41 and the output shaft 42. When the swing door 2 is opened and closed manually, the clutch mechanism cuts off the transmission of power between the motor 41 and the output shaft 42. This allows the user to manually open and close the swing door 2 lightly.

Figure 5:
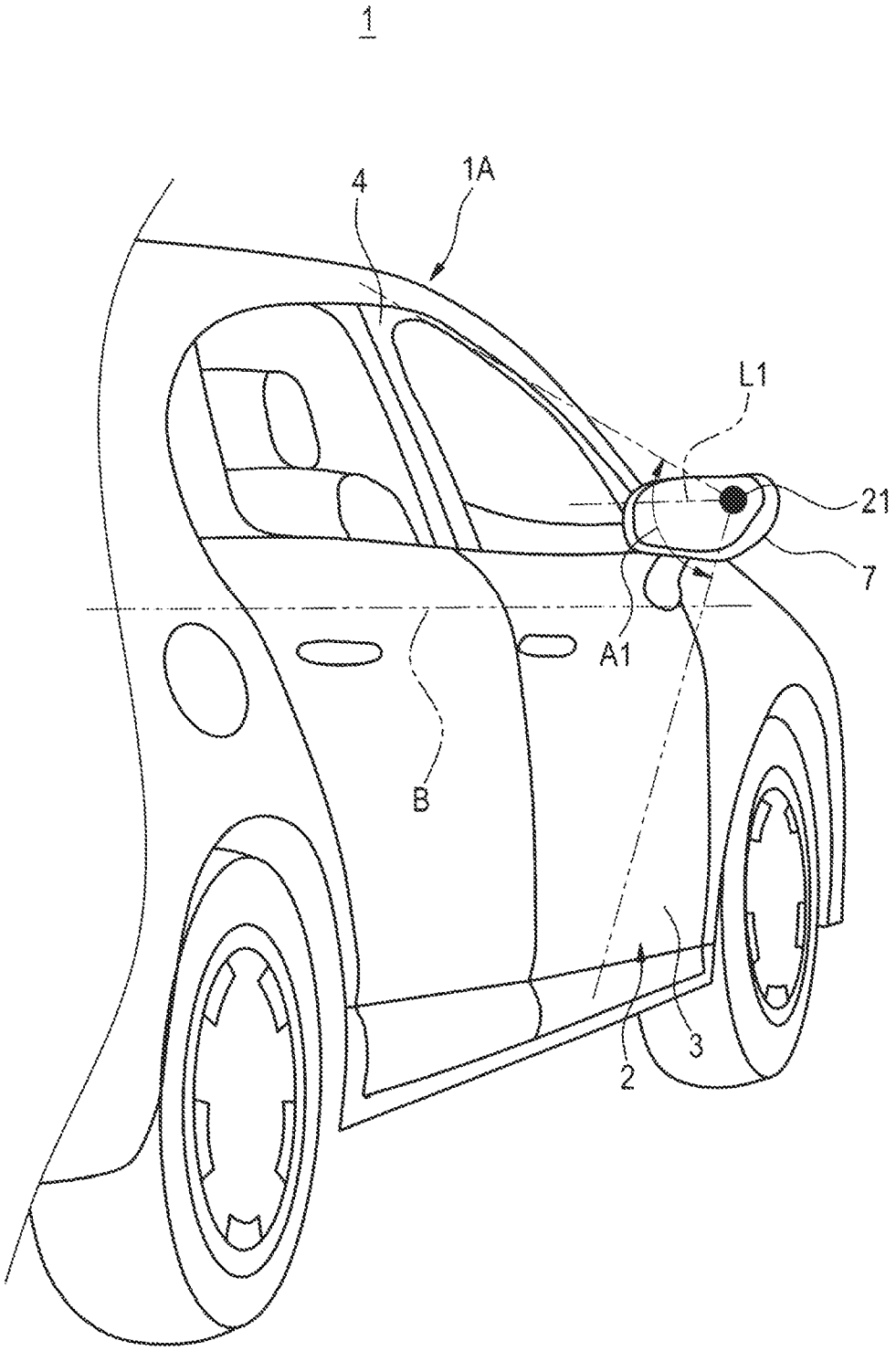
FIG. 5 is a schematic diagram of an arrangement example of a distance sensor shown in FIG. 1.
Figure 6:
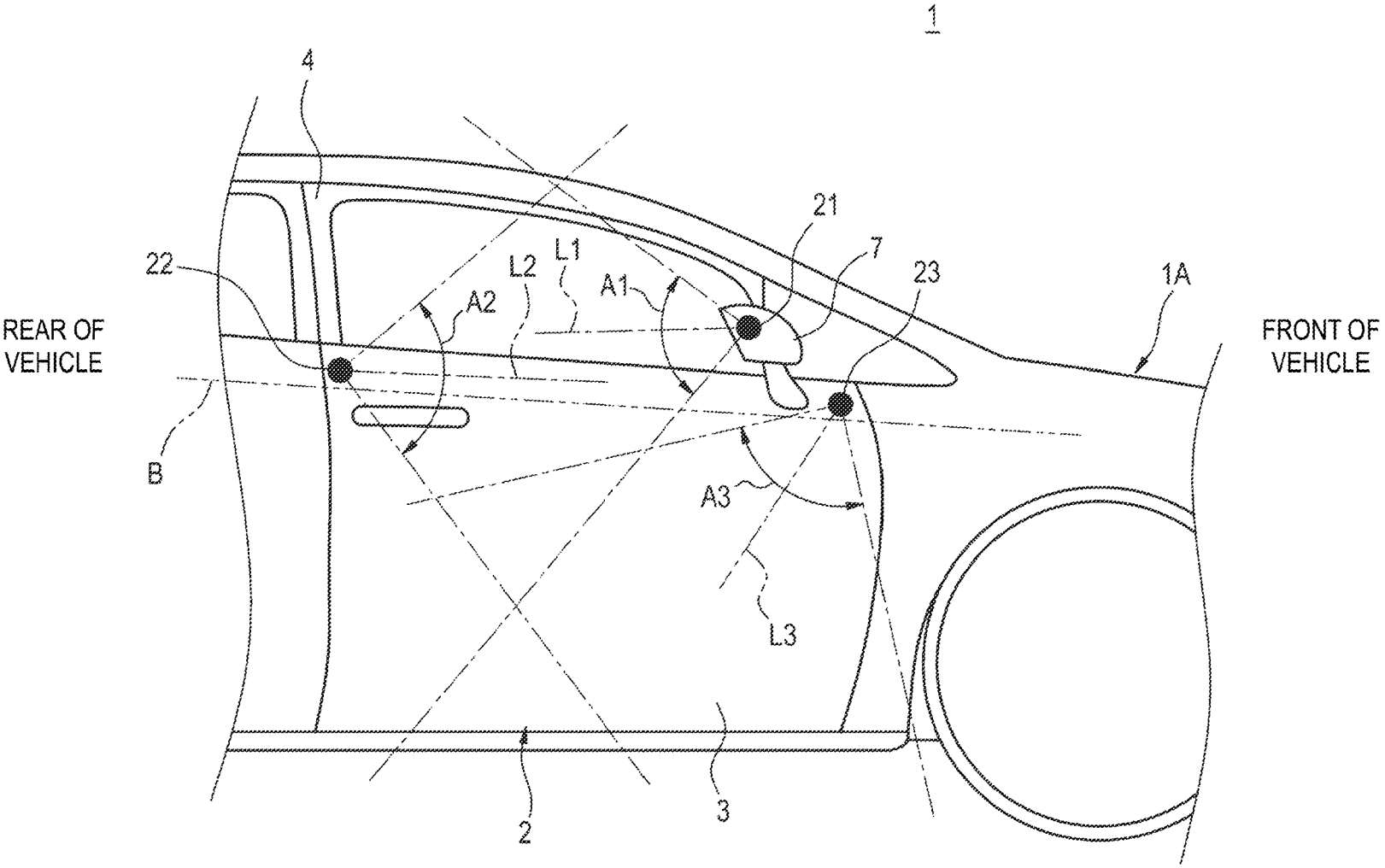
FIG. 6 is a schematic diagram of the arrangement example of distance sensors shown in FIG. 1.

FIGS. 5 and 6 show an example of an arrangement of the first distance sensor 21 to the third distance sensor 23 of the distance measuring device 20. In FIG. 5, as a matter of convenience in description, the second distance sensor 22 and the third distance sensor 23 are omitted from illustration.

As shown in FIGS. 5 and 6, the distance measuring device 20 measures a distance between the external surface of the swing door 2 and an object by use of the three distance sensors 21 to 23 on the swing door 2 for the driver's seat. The three distance sensors 21 to 23 are placed dispersively over the swing door 2 (e.g., in such a manner as to spread over the swing door 2) so that the whole of the external surface of the swing door 2 is included within a measuring range. By including the whole of the external surface of the swing door 2 in the measuring range, an obstacle can be detected with good accuracy before the swing door 2 comes into contact with the obstacle, whereby the contact of the swing door 2 with the obstacle can be avoided in an ensured fashion.

Firstly, as shown in FIG. 5, an outside rearview mirror 7 is provided on the swing door 2. The outside rearview mirror 7 is disposed at an upper portion of the front end portion of the door main body 3 and is also disposed to protrude further outwards of the vehicle main body 1A than the external surface of the swing door 2. The first distance sensor 21 is placed on the outside rearview mirror 7. Then, the first distance sensor 21 has a first measuring range A1 that expands into a circular conical shape centered at a center line L1 extending towards the rear of the vehicle 1.

As shown in FIG. 6, the second distance sensor 22 is disposed at a rear end portion of the door main body 3 on or above a belt line B extending along an upper edge of the door main body 3. Then, the second distance sensor 22 has a second measuring range A2 that expands into a circular conical shape centered at a center line L2 extending towards the center of the vehicle 1. Additionally, the third distance sensor 23 is disposed at a front end portion of the door main body 3 on or above a belt line B. Then, the third distance sensor 23 has a third measuring range A3 that expands into a circular conical shape centered at a center line L3 extending towards a lower side of the vehicle 1 while sloping downwards towards the rear of the vehicle 1.

Depending upon types of the first distance sensor 21 to the third distance sensor 23, respective vertex angles of the first measuring range A1 to the third measuring range A3 are generally around 120°.

Here, the external surface of the swing door 2 is typically curved into an arc-like shape in which an upper edge and a lower edge of the swing door 2 lie further transversely inwards of the vehicle 1 than the belt line B. When the external surface of the swing door 2 is divided into an upper zone lying on an upper side of the belt line B, with the belt line B being a boundary, and a lower zone lying on a lower side of the belt line B, the lower zone on the external surface of the swing door 2 tends to constitute a blind spot for, for example, a distance sensor placed at an upper edge portion of the sash 4, and the upper zone on the external surface of the swing door 2 tends to constitute a blind spot for a distance sensor placed at a lower edge portion of the door main body 3.

In contrast to this, the first distance sensor 21 that is placed on the outside rearview mirror 7 disposed to protrude from the external surface of the swing door 2 can include a wide range of both the upper zone and the lower zone on the external surface of the swing door 2 within in its measuring range. This can reduce the number of sensors necessary to include the whole of the external surface of the swing door 2 in the measuring range. However, due to a limitation on the vertex angle of the first measuring range A1 that expands into the circular conical shape towards the rear of the vehicle 1, a blind spot for the first distance sensor can be generated directly above and directly below the first distance sensor 21, as well as ahead of the first distance sensor. Then, the whole of the external surface of the swing door 2 is included in the measuring device by complementing the first measuring range A1 using the additional distance sensors.

The second distance sensor 22 that is placed at the rear end portion of the door main body 3 on or above the belt line B has the second measuring range A2 expanding into the circular conical shape to the front of the vehicle 1, and the placement of the second distance sensor 22 is preferable in including the zones on the external surface of the swing door 2 that lie directly above and directly below the first distance sensor 21, as well as the zone lying ahead of the first distance sensor.

In the example shown in FIG. 6, a zone deviating from the first measuring range A1 and the second measuring range A2 on the external surface of the swing door 2 exists substantially at a center in a front-rear direction of a lower edge portion of the swing door 2. The third distance sensor 23 placed at the front end portion of the door main body 3 on or above the belt line B has the third measuring range A3 that expands into to the circular conical shape downwards towards the lower side of the vehicle while sloping downwards to the rear of the vehicle and is preferable in including the zone described above in the measuring range.

Figure 7:
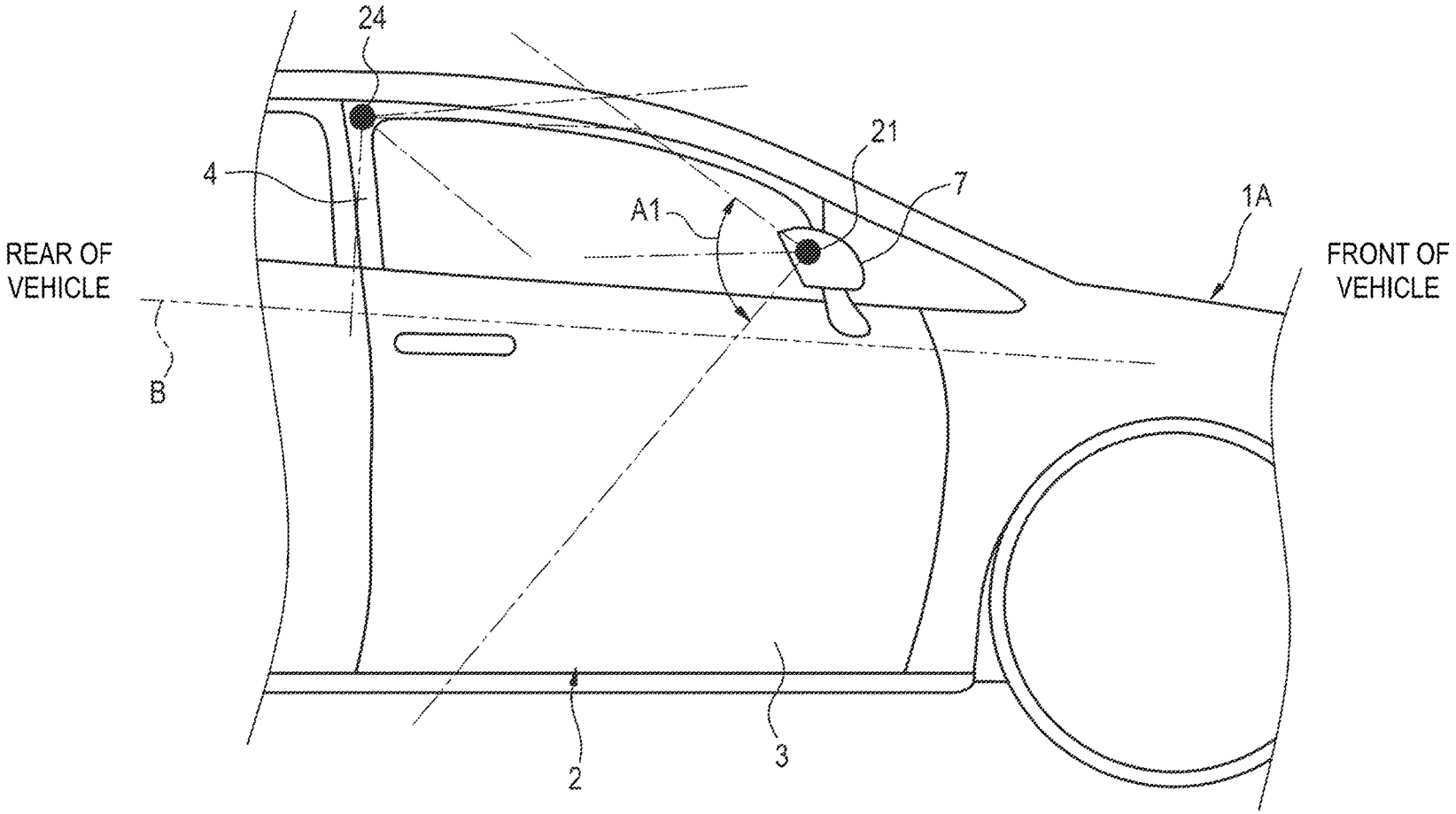
FIG. 7 is a schematic diagram of another arrangement example of distance sensors shown in FIG. 1.
Figure 8:
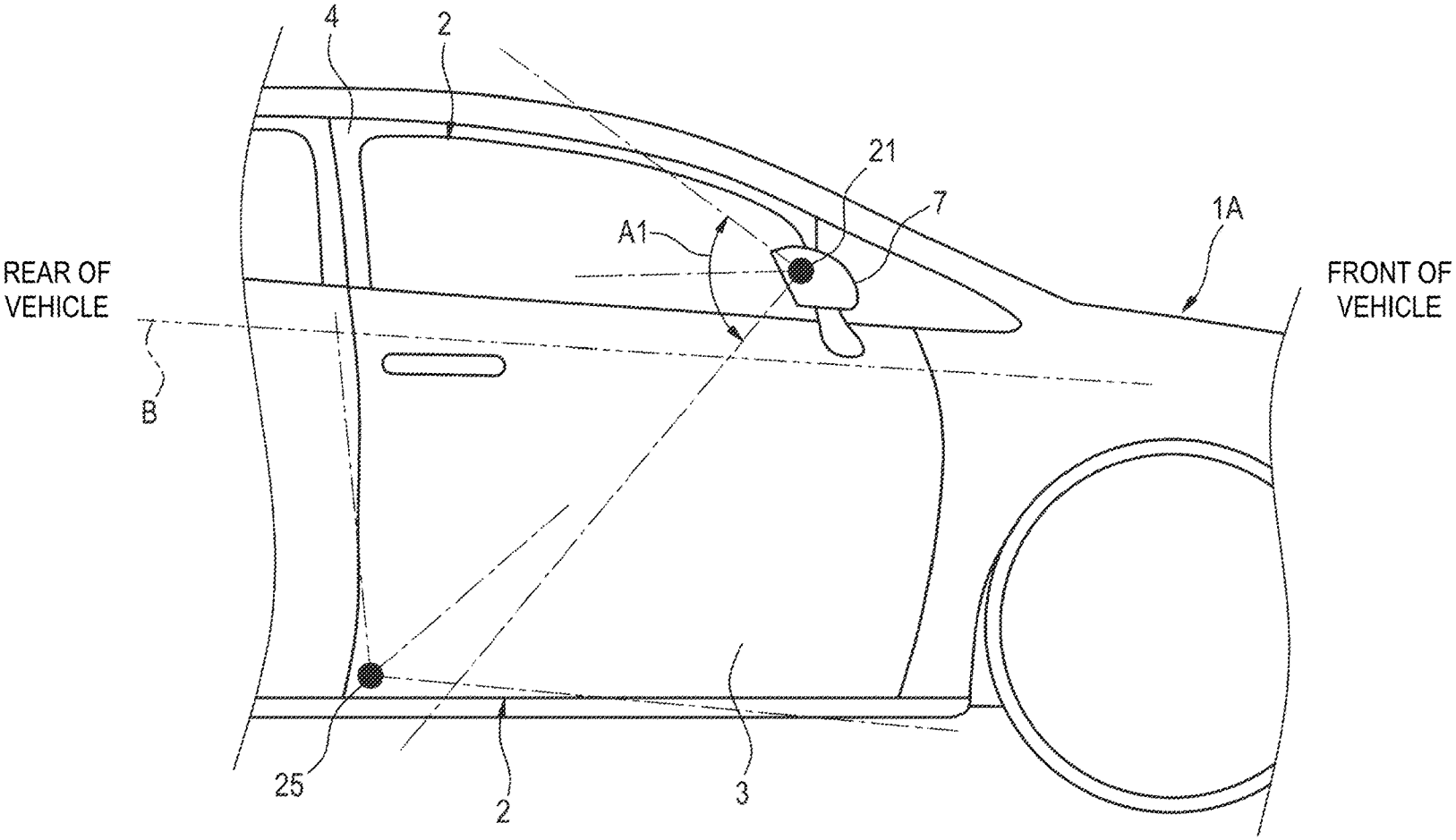
FIG. 8 is a schematic diagram of a further arrangement example of distance sensors shown in FIG. 1.

The arrangement of the plurality of distance sensors is not limited to the example described above. For example, as shown in FIG. 7, a fourth distance sensor 24 placed at a rear end of an upper edge portion of the sash 4 can include the zones that lie directly above and ahead of the first distance sensor 21 in the upper zone on the external surface of the swing door 2 and deviate from the first measuring range Al in its measuring range. Additionally, as shown in FIG. 8, a fifth distance sensor 25 placed at a rear end of the lower edge portion of the door main body 3 can include the zones that lie directly below and ahead in the lower zone on the external surface of the swing door 2 and deviate from the first measuring range Al in its measuring range.

Next, a process of opening the swing door 2 executed by the control device 60 will be described.

As described above, the control device 60 controls the swing door 2 to open and stop based on a distance between the external surface of the swing door 2 and an object on the circumference of the swing door 2 that is measured by the distance measuring device 20 (hereinafter, referred to as a measured distance). In this control, a first predetermined distance T1 and a second predetermined distance T2 are used as thresholds for the measured distance.

Figure 9:
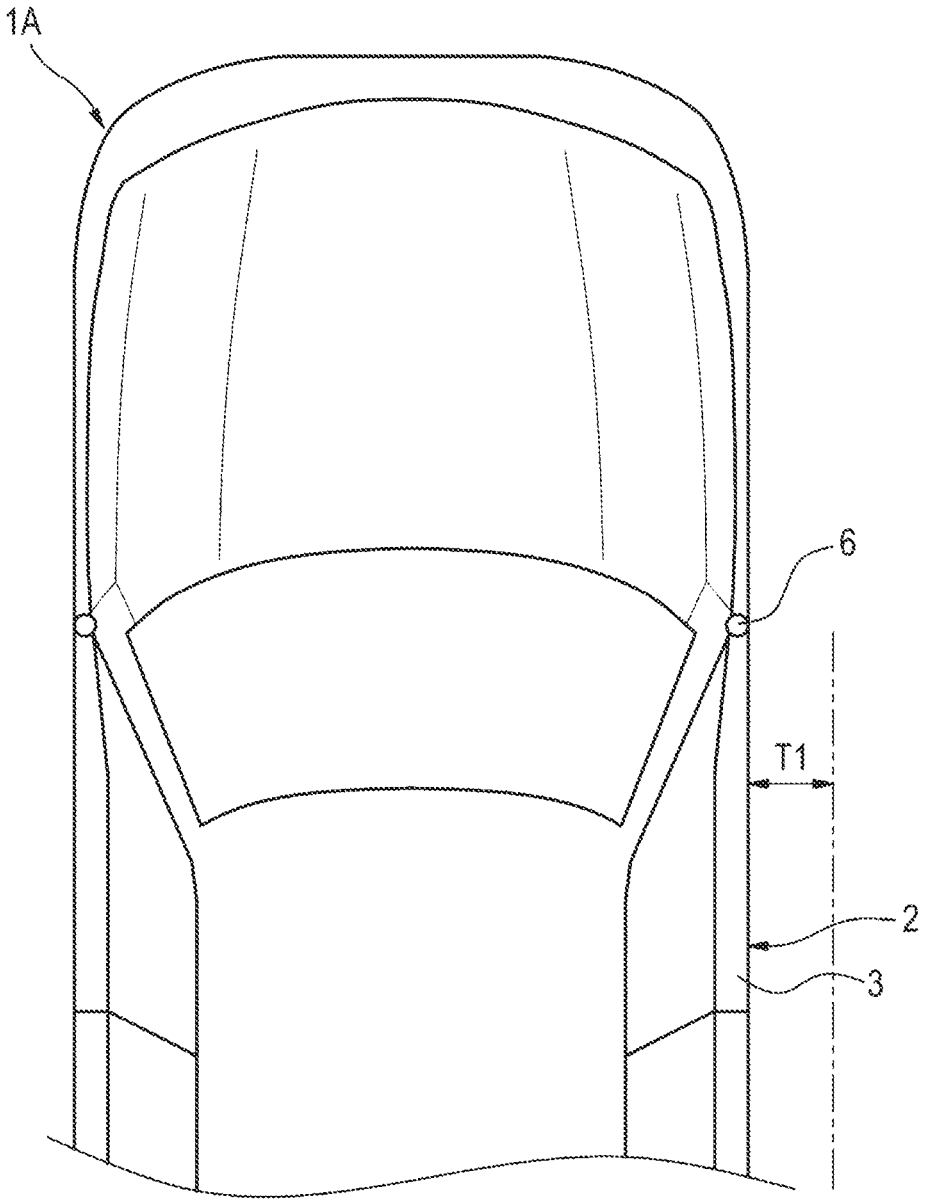
FIG. 9 is a schematic diagram depicting an example of a first predetermined distance set in a control device shown in FIG. 1.
Figure 10:
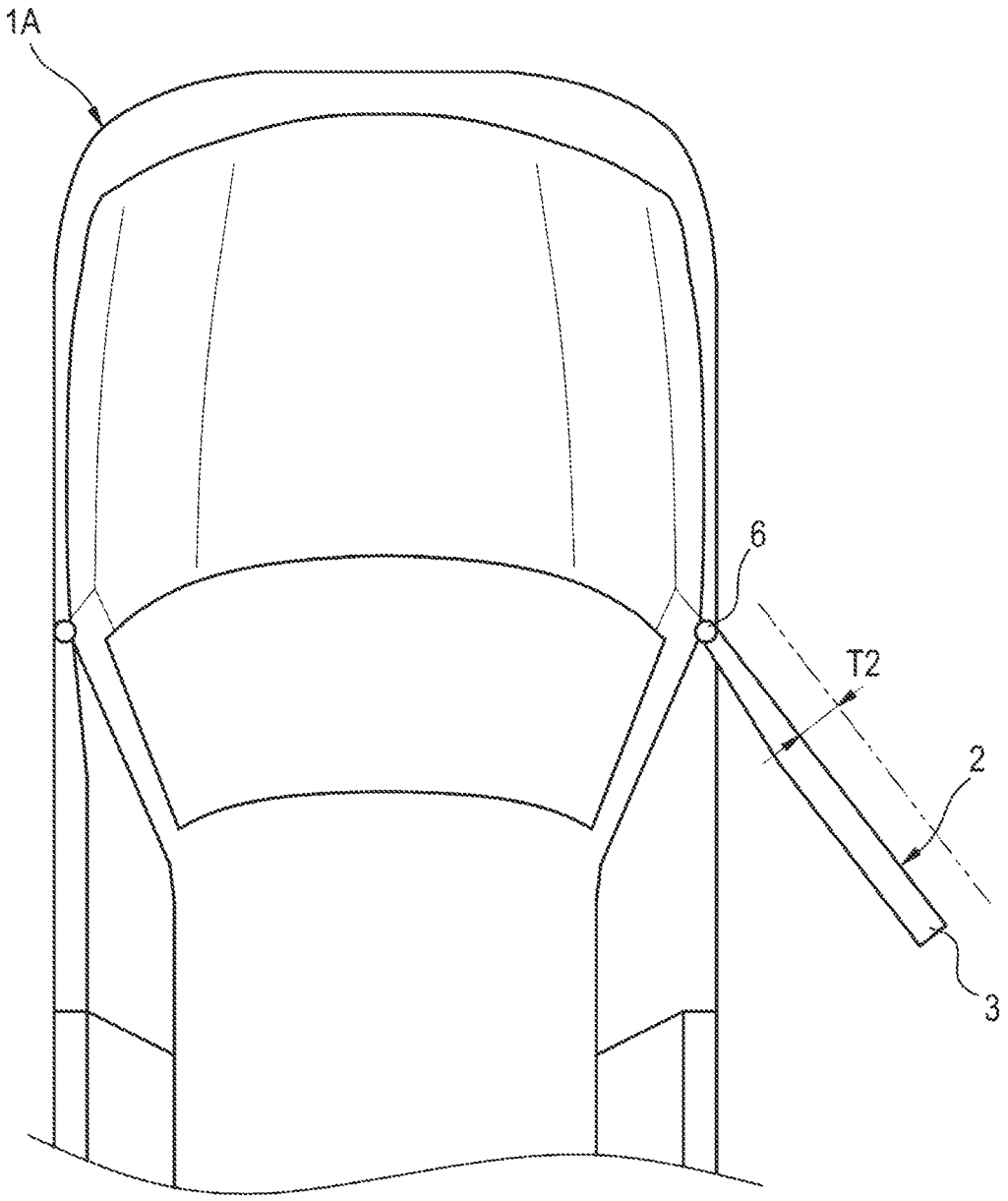
FIG. 10 is a schematic diagram depicting an example of a second predetermined distance set in the control device shown in FIG. 1.

FIG. 9 shows an example of the first predetermined distance T1, and FIG. 10 shows an example of the second predetermined distance T2.

The first predetermined distance T1 is a threshold applied when the control device 60 receives a door opening command from the door opening operation input device 50. As shown in FIG. 9, with the swing door 2 staying in the closed state, the control device 60 determines whether the measured distance is the first predetermined distance T1 or smaller before the control device 60 activates the door lock device 30 and the drive device 40 to open the swing door 2. When determining that the measured distance is the first predetermined distance T1 or smaller, the control device 60 recognizes the object as an obstacle and suspends the opening process of the swing door 2. On the other hand, when determining that the measured distance is greater than the first predetermined distance T1, the control device 60 recognizes the object as a non-obstacle and then starts to open the swing door 2 by activating the door lock device 30 and the drive device 40.

The second predetermined distance T2 is a threshold applied when the swing door 2 is being opened. As shown in FIG. 10, the control device 60 determines whether a measured distance is the second predetermined distance T2 or smaller after the control device 60 starts to open the swing door by activating the door lock device 30 and the drive device 40. When determining that the measured distance is the second predetermined distance T2 or smaller, the control device 60 recognizes the object as an obstacle and stops the swing door 2 from opening. On the other hand, when determining that the measured distance is greater than the second predetermined distance T2, the control device 60 recognizes the object as a non-obstacle and then allows the swing door 2 to keep opening.

The first predetermined distance T1 is set in consideration of an opening angle of the swing door 2 to which the swing door 2 is opened when the vehicle user gets in or out of the vehicle and is 100 mm, for example. The second predetermined distance T2 can be set to preferably be smaller than the first predetermined distance T1 in consideration of a quick responsibility required when the swing door 2 is stopped opening from the viewpoint of an opening angle of the swing door 2 when the swing door 2 is opened as wide as possible and avoiding a contact of the swing door 2 with an obstacle. Although depending upon the weight and opening speed of the swing door 2, the second predetermine distance T2 is 50 mm, for example.

Figure 11A:
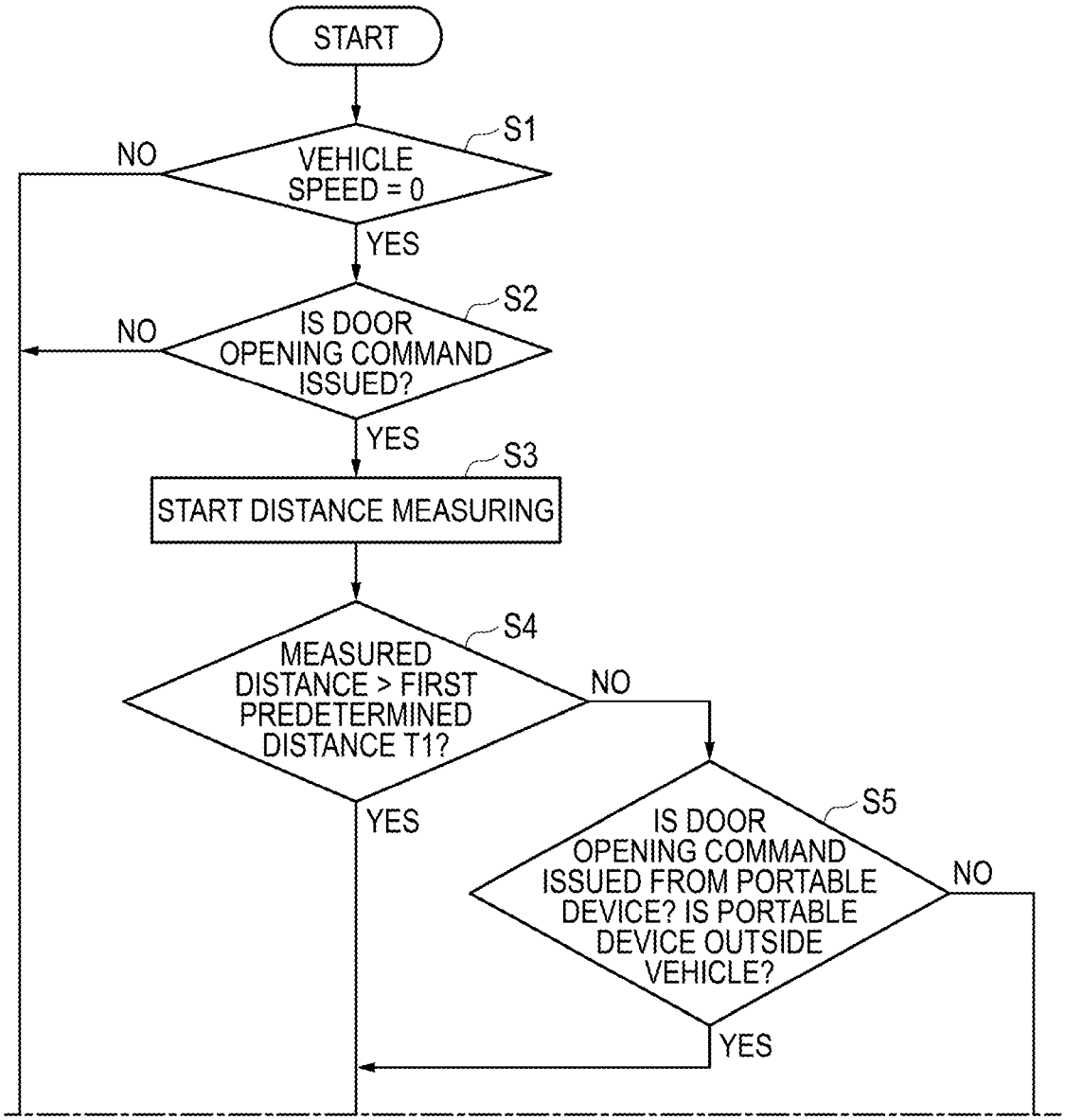
FIGS. 11A and 11B illustrate a flow chart of an example of a door opening process executed by the control device shown in FIG. 1.
Figure 11B:
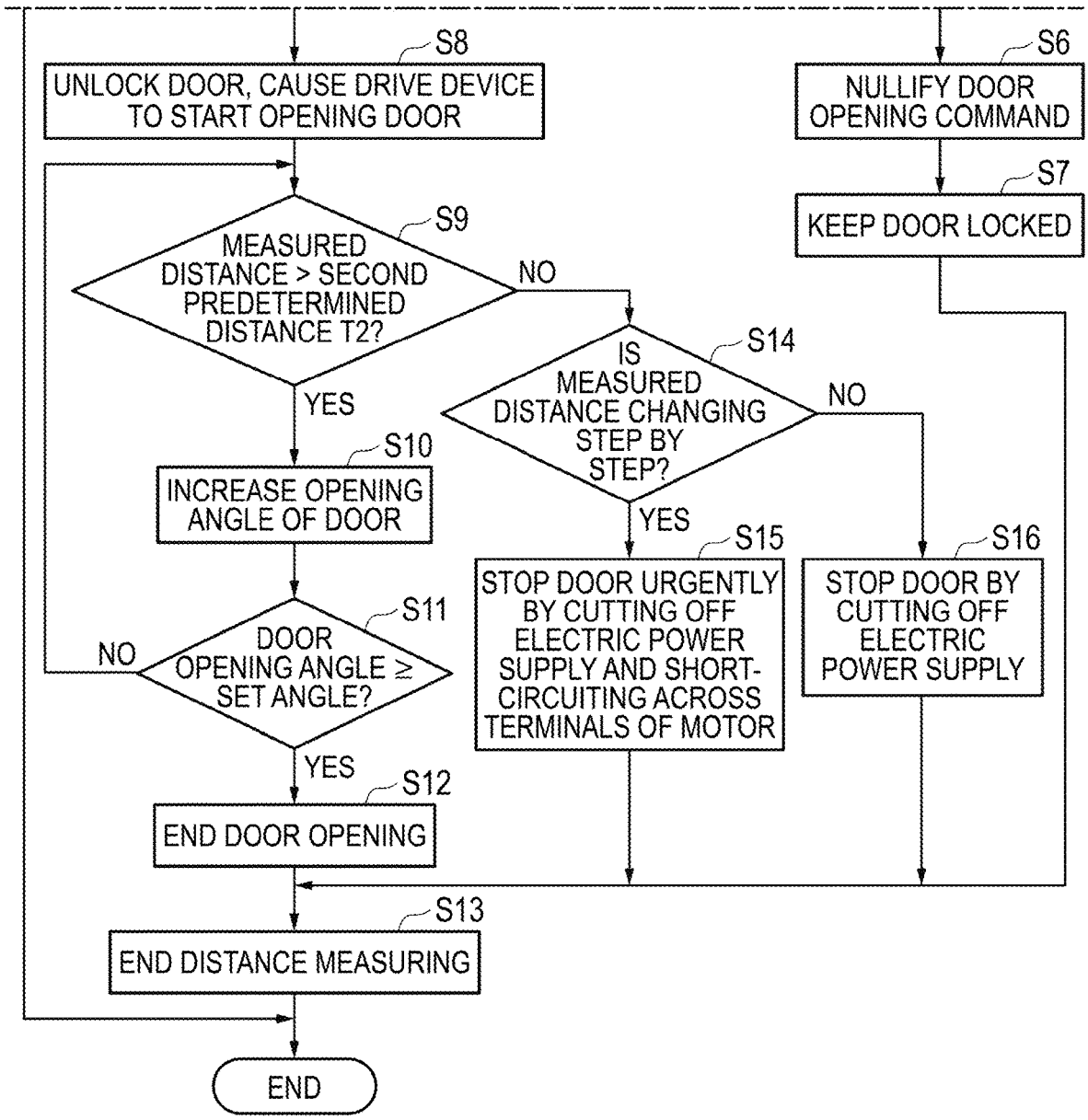

FIGS. 11A and 11B show an example of a door opening process that the control device 60 executes.

The control device 60 determines based on a vehicle speed signal inputted from the vehicle speed sensor 70 whether the vehicle 1 is stopped (step S1). If the control device 60 determines from the results of the determination that the vehicle 1 is stopped (YES in step S1), the door opening process proceeds to step S2. On the other hand, if the control device 60 determines that the vehicle 1 is not stopped (NO in step S1), the control device 60 ends the door opening process (END).

The control device 60 determines whether the door opening operation input device 50 issues a door opening command (step S2). If the control device 60 determines as the result of the determination that the door opening command is issued (YES in step S2), the control device 60 starts a measuring of a distance by the distance measuring device 20 (step S3). On the other hand, if no door opening command is issued (NO in step S2), the control device 60 ends the door opening process (END).

The control device 60 acquires a measured distance and determines whether the acquired measured distance is greater than the first predetermined distance T1 (step S4). As the result of the determination, if the measured distance is greater than the first predetermined distance T1 (YES in step S4), the control device 60 cancels the locking of the striker by the latch device 31 of the door lock device 30 to unlock the swing door 2 and activates the drive device 40 to start opening the swing door 2 (step S8).

On the other hand, if the measured distance acquired in step S4 is the first predetermined distance T1 or smaller (NO in step S4), the control device 60 determines whether the door opening command issued in step S2 is issued by the portable device 52 and whether the portable device 52 stays outside the vehicle main body 1A (step S5).

As the result of the determination in step S5, if the door opening command is issued by the portable device 52 and if the portable device 52 stays outside the vehicle main body 1A (YES in step S5), since it can be considered that the user inputs a door opening operation or command into the portable device 52 after recognizing the situations around the swing door 2, the control device 60 makes the door opening command effective and proceeds to step S8 where the control device 60 starts opening the swing door 2.

As the result of the determination made in step S5, if the door opening command is issued from any one of the switches 51 other than the portable device 52 or if the portable device 52 stays inside the vehicle main body 1A (NO in step S5), there is a possibility that the vehicle user may not recognize the situations around the swing door 2, and when the swing door 2 starts opening in these circumstances, the swing door 2 may come into contact with the obstacle. Then, the control device 60 nullifies the door opening command (step S6) and maintains the locking of the swing door 2 by the door lock device 30 (step S7). Even though an obstacle exists within a rotating range of the swing door 2 when the swing door 2 is rotated by a reaction force of a door seal, since the swing door 2 is kept locked, the rotation of the swing door attributed to the reaction force of the door seal is prevented, whereby a contact of the swing door 2 with the obstacle is avoided. Additionally, when the vehicle 1 is moved to change stopping positions, a labor hour to relock the swing door 2 is saved. Thereafter, the drive device 60 ends the measuring of a distance by the distance measuring device 20 (step S13) and ends the door opening process (END).

After having started opening the swing door 2 in step S8, the control device 60 acquires a measured distance again and determines whether the acquired measured distance is greater than the second predetermined distance T2 (step S9). As the result of the determination, if the measured distance is greater than the second predetermined distance T2 (YES in step S9), the control device 60 keeps the drive device 40 operating to expand the opening angle of the swing door 2 by a predetermined angle (step S10).

Then, the control device 60 determines based on an opening angle signal inputted from the opening angle sensor 80 whether the opening angle of the swing door 2 is equal to or greater than a set angle for automatic door opening (step S11). As the result of the determination, if the opening position of the swing door 2 is the set angle or greater (YES in step S11), the control device 60 stops the drive device 40 to end the opening of the swing door 2 (step S12). On the other hand, the control device 60 returns to step S9 if the opening angle of the swing door 2 is smaller than the set angle (NO in step S11).

If the measured distance acquired in step S9 is reduced to the second predetermined distance T2 or smaller before the opening angle of the swing door 2 reaches or exceeds the set angle (NO in step S9), the control device 60 determines whether the measured distance changes step by step (step S14). In making this determination, an appropriate threshold is used for a variation in measured distance, for example.

As the result of the determination made in step S14, if the measured distance is reduced step by step to the second predetermined distance T2 or smaller (YES in step S14), the control device 60 controls the opening and closing circuit 46 not only to cut off the supply of electric power to the motor 41 but also to short-circuit across the terminals of the motor 41 to thereby stop the swing door 2 quickly or urgently (step S15). As an example of the measured distance changing step by step, a case where a small animal such as a dog or a cat jumps into the opening path of the swing door 2 is considered. In such a case, a contact of the swing door 2 with such an obstacle can be avoided by urgently stopping the swing door 2, and if such a contact should occur, an impact given to both the swing door 2 and the obstacle can be reduced.

As the result of the determination made in step S14, if the measured distance changes moderately to the second predetermined distance T2 or smaller (NO in step S14), the control device 60 controls the opening and closing circuit 46 to cut off the supply of electric power to the motor 41 to stop the swing door 2 (step S16). When the measured distance changes moderately, at a timing at which the swing door 2 is stopped, the second predetermined distance T2, which is set in consideration of the quick responsibility of the swing door 2, is left between the swing door 2 and the obstacle. Consequently, a contact of the swing door 2 with the obstacle can be avoided without urgently stopping the swing door 2.

According to the automatic door opening and closing system 10 described heretofore, the distance measuring device 20 measures a distance between the external surface of the swing door 2 and an object lying on the circumference of the swing door 2 with the whole of the external surface of the swing door 2 being the measuring range by use of the three distance sensors 21 to 23 that are placed to spread over the swing door 2. As a result, an obstacle lying on the circumference of the swing door 2 can be detected accurately and in an ensured fashion before the swing door 2 comes into contact with the obstacle, thereby making it possible to avoid in advance a contact of the swing door 2 with the obstacle.

Additionally, according to the automatic door opening and closing system 10 described heretofore, when receiving a command from the door opening operation input device 50, firstly, the control device 60 starts measuring a distance between the swing door 2 and an object lying on the circumference of the swing door 2. As a result, even though an obstacle exists extremely near to the swing door 2, that is, an obstacle exists within the rotating range of the swing door 2 when the swing door 2 is rotated by the reaction force of the door seal, a contact of the swing door 2 with the obstacle can be avoided in advance.

Thus, as has been described heretofore, the automatic door opening and closing system disclosed in this specification includes the distance measuring device configured to measure a distance between the external surface of the swing door of the vehicle and an object lying on the circumference of the swing door, the door lock device configured to lock the swing door in the closed state, the drive device configured to open and close the swing door, the door opening operation input device configured to operate the door lock device to cancel the locking of the swing door by the door lock device and the drive device to open the swing door, and the control device configured to control the door lock device and the drive device based on the distance measured by the distance measuring device in response to an operation input at the door opening operation input device, and the distance measuring device includes the plurality of distance sensors that are placed to spread over the swing door, the whole of the external surface of the swing door constituting the measurement target.

In the automatic door opening and closing system disclosed in this specification, the distance measuring device includes the distance sensor that is placed on the outside rearview mirror disposed in such a manner as to protrude further transversely outwards than the external surface of the swing door.

In the automatic door opening and closing system disclosed in this specification, the distance measuring device includes the distance sensor that is placed at the hinge side end portion and/or the distal end portion opposite to the hinge side end portion of the swing door on the belt line of the vehicle.

In the automatic door opening and closing system disclosed in this specification, the swing door is the door including the sash, and the distance measuring device includes the distance sensor that is placed at the distal end portion opposite to the hinge side end portion of the swing door at the door upper portion lying on the upper side of the vehicle above the belt line of the vehicle.

In the automatic door opening and closing system disclosed in this specification, the second predetermined distance is smaller than the first predetermined distance.

In the automatic door opening and closing system disclosed in this specification, the distance measuring device includes the distance sensor that is placed at the distal end portion opposite to the hinge side end portion of the swing door at the door lower portion lying on the lower side of the vehicle below the belt line of the vehicle.

The automatic door opening and closing system disclosed in this specification includes the distance measuring device configured to measure a distance between the external surface of the swing door of the vehicle and an object lying on the circumference of the swing door, the door lock device configured to lock the swing door in the closed state, the drive device configured to open and close the swing door, the control device configured to control the door lock device and the drive device based on a distance measured by the distance measuring device, and the door opening operation input device configured to instruct the control device to control the door lock device to cancel the locking of the swing door thereby and the drive device to open the swing door, and the control device starts the measuring of a distance upon receiving the command from the door opening operation input device and continues measuring the distance until the drive device stops opening the swing door.

In the automatic door opening and closing system disclosed in this specification, in the case where the measured distance when the command is received from the door opening operation input device is the first predetermined distance or smaller, the control device nullifies the command from the door opening operation input device and holds the swing door locked.

In the automatic door opening and closing system disclosed in this specification, the door opening operation input device includes the portable device carried by the vehicle user, and the control device includes the receiver that receives a command from the portable device in a wireless fashion and can identify whether the portable device stays outside or inside the vehicle. Then, with the measured distance when the command is received from the door opening operation input device being the first predetermined distance or smaller, when the command received is sent from the portable device and the portable device stays outside the vehicle, the control device effects the command from the door opening operation unit, controlling the door lock device to cancel the locking of the swing door thereby and the drive device to open the swing door.

In the automatic door opening and closing system disclosed in this specification, in the case where the measured distance becomes the second predetermined distance or smaller while the swing door is being opened by the drive device, the control device controls the drive device to stop the swing door.

In the automatic door opening and closing system disclosed in this specification, the second predetermined distance is smaller than the first predetermined distance.

In the automatic door opening and closing system disclosed in this specification, the drive device includes the motor and the opening and closing circuit configured to short-circuit across the terminals of the motor, and when the measured distance is reduced step by step to the second predetermined distance or smaller while the swing door is being opened by the drive device, the control device controls the opening and closing circuit to short-circuit across the terminals of the motor to thereby stop the swing door urgently.

The foregoing description of the illustrative embodiments of the present invention has been provided for the purposes of illustration and description. It is not intended to be exhaustive or to limit the invention to the precise forms disclosed. Obviously, many modifications and variations will be apparent to practitioners skilled in the art. The illustrative embodiments were chosen and described in order to best explain the principles of the invention and its practical applications, thereby enabling others skilled in the art to understand the invention for various illustrative embodiments and with the various modifications as are suited to the particular use contemplated. It is intended that the scope of the invention be defined by the claims and their equivalents.

What is claimed is:

1. An automatic door opening and closing system, comprising:

a distance measuring device configured to measure a distance between an external surface of a swing door of a vehicle and an object lying on a circumference of the swing door;

a door lock device configured to lock the swing door in a closed state;

a drive device configured to open and close the swing door;

a door opening operation input device configured to receive an operation to cancel the locking of the swing door by the door lock device and to open the swing door by the drive device; and a control device configured to, in response to receiving the operation by the door opening operation input device, control the door lock device and the drive device based on the distance measured by the distance measuring device, wherein the distance measuring device comprises a plurality of distance sensors installable dispersively over the swing door, a measurement target by the distance measuring device including a whole of the external surface of the swing door.

2. The automatic door opening and closing system according to claim 1, wherein the plurality of distance sensors comprises a first distance sensor installable on an outside rearview mirror, the outside rearview mirror being disposed in such a manner as to protrude further transversely outwards than the external surface of the swing door.

3. The automatic door opening and closing system according to claim 2, wherein the plurality of distance sensors comprises at least one of a second distance sensor installable a rear end portion of the swing door on or above a belt line of the vehicle or a third distance sensor installable at a hinge side end portion of the swing door on or above the belt line of the vehicle.

4. The automatic door opening and closing system according to claim 2, wherein the swing door includes a sash, and wherein the plurality of distance sensors comprises a fourth distance sensor installable at a rear end portion of the swing door at a door upper portion on an upper side of the vehicle above the belt line of the vehicle.

5. The automatic door opening and closing system according to claim 2, wherein the plurality of distance sensors comprises a fifth distance sensor installable at the rear end portion of the swing door at a door lower portion on a lower side of the vehicle below the belt line of the vehicle.

6. The automatic door opening and closing system according to claim 1, wherein a front end portion of the swing door is configured to be supported on a vehicle body via a hinge, and wherein the plurality of distance sensor comprises:

a first distance sensor installable on a rearview mirror, the rearview mirror being disposed on the swing door; and a second distance sensor installable at a rear end portion of the swing door.

7. The automatic door opening and closing system according to claim 6, wherein the plurality of distance sensor further comprises:

a third distance sensor installable at the first end portion of the swing door, the third distance sensor being located across the first distance sensor from the second distance sensor.

8. The automatic door opening and closing system according to claim 1, wherein the plurality of distance sensors comprises a first distance sensor installable on an outside rearview mirror, the outside rearview mirror being disposed at an upper portion of a front end portion of the swing door, the front end portion of the swing door being configured to be supported on a vehicle body via a hinge extending in a vertical direction of the vehicle.

* * * * *